US007845633B2

(12) United States Patent
Ichimura

(10) Patent No.: US 7,845,633 B2
(45) Date of Patent: Dec. 7, 2010

(54) ABNORMAL SHEET DELIVERY DETECTION DEVICE

(75) Inventor: Shoichi Ichimura, Ibaraki (JP)

(73) Assignee: Komori Corporation, Tokyo (JP)

( * ) Notice: Subject to any disclaimer, the term of this patent is extended or adjusted under 35 U.S.C. 154(b) by 217 days.

(21) Appl. No.: 11/726,246

(22) Filed: Mar. 21, 2007

(65) Prior Publication Data

US 2007/0284802 A1 Dec. 13, 2007

(30) Foreign Application Priority Data

Apr. 7, 2006 (JP) ..... 2006-106103

(51) Int. Cl.
*B65H 43/00* (2006.01)

(52) U.S. Cl. ..... 271/176; 271/204; 271/298; 271/299; 271/300

(58) Field of Classification Search ..... 271/204, 271/298, 299, 300, 176, 199
See application file for complete search history.

(56) References Cited

U.S. PATENT DOCUMENTS

| | | | | |
|---|---|---|---|---|
| 4,934,683 | A * | 6/1990 | Ueda et al. | 271/3.04 |
| 5,140,166 | A | 8/1992 | Gerlier | |
| 5,351,946 | A * | 10/1994 | Kamoda et al. | 271/206 |
| 5,852,764 | A * | 12/1998 | Kida et al. | 399/401 |
| 6,283,471 | B1 | 9/2001 | Kunzel et al. | |
| 6,988,724 | B2 * | 1/2006 | Hirai | 271/204 |
| 7,367,558 | B2 * | 5/2008 | Forch et al. | 271/206 |
| 2003/0151752 | A1 | 8/2003 | Langbein et al. | |
| 2004/0113350 | A1 * | 6/2004 | Forch et al. | 271/69 |
| 2005/0006840 | A1 * | 1/2005 | Kusaka | 271/298 |
| 2007/0194519 | A1 * | 8/2007 | Belanger | 271/204 |

FOREIGN PATENT DOCUMENTS

| | | |
|---|---|---|
| DE | 100 13 982 A1 | 10/2000 |
| JP | 63-137844 A | 6/1988 |
| JP | 06-011785 Y | 3/1994 |

* cited by examiner

*Primary Examiner*—Patrick Mackey
*Assistant Examiner*—Prasad V Gokhale
(74) *Attorney, Agent, or Firm*—Blakely, Sokoloff, Taylor & Zafman

(57) ABSTRACT

An abnormal sheet delivery detection device includes a convey device, first pile device, noncontact-type detection unit, and first releasing unit. The convey device includes a sheet holding unit for holding a sheet, and conveys the sheet held by the sheet holding unit. The sheet released from the sheet holding unit is piled on the first pile device at a predetermined sheet release position. The noncontact-type detection unit arranged downstream of the sheet release position in a sheet convey direction detects a presence/absence of the sheet. The first releasing unit selectively switches between a first state wherein the sheet held by the sheet holding unit is released and piled on the first pile device, and a second state wherein the sheet held by the sheet holding unit is conveyed downstream in the sheet convey direction by the first convey device without releasing the sheet.

14 Claims, 8 Drawing Sheets

ABNORMAL SHEET DELIVERY DETECTION DEVICE

BACKGROUND OF THE INVENTION

The present invention relates to an abnormal sheet delivery detection device which detects that a sheet conveyed by a convey means is delivered to a position other than a normal position.

In order to align the edges of the delivered sheets in a stacked state, a sheet delivery apparatus generally adjusts the position of a sheet release cam, adjusts an air blowing amount for dropping the sheet onto a pile device, and adjusts the air suction amount of a suction wheel which decreases a sheet convey speed by sucking the conveyed sheet. If these adjustment processes are not sufficiently performed, abnormal sheet delivery occurs, e.g., a sheet released from a delivery gripper overrides a lay, or the trailing edge of the sheet remains on the suction wheel. Such abnormal sheet delivery leads to an increase in the amount of wasted paper, and the trouble of a machine when continuing abnormal sheet delivery in this state. In order to prevent these troubles, the sheet delivery apparatus includes the abnormal sheet delivery detection device.

As disclosed in Japanese Utility Model Publication No. 06-11785, a conventional abnormal sheet delivery detection device includes a lay against which the leading edge of the sheet released from the delivery gripper abuts, a pile board on which the sheets whose edges are aligned by the lay are piled, a paper guide arranged above the pile board, a reflection plate arranged above the paper guide, and a reflection-type photoelectric switch which applies light to the reflection plate to detect the sheet conveyed on the paper guide and abnormally delivered.

Since the reflection-type photoelectric switch is arranged upstream of the lay in a sheet convey direction, the above-described conventional abnormal sheet delivery detection device can be applied to only a sheet-fed printing press in which the delivered sheets are piled on one pile board. That is, a printing press with a plurality of (the first and second) pile boards arranged from upstream to downstream in the sheet convey direction cannot identify whether a sheet passing above the first pile board is a sheet to be stacked on the second pile board, or an abnormally delivered sheet to be piled on the first pile board. To solve such problem, the abnormal sheet delivery detection device shown in FIG. 8 has been proposed.

Referring to FIG. 8, a pair of sprockets 103 are rotatably supported at the upper rear ends of a pair of delivery frames 102 arranged to oppose each other at a predetermined gap. A pair of delivery chains 105 which travel in the direction of an arrow A are looped between the sprockets 103 and a pair of sprockets 104 arranged to be coaxial with a delivery cylinder which is in contact with the last printing cylinder. Between the pair of delivery chains 105, a gripper bar having a plurality of delivery grippers 106 which grip and convey a sheet 112 serving as a paper sheet is supported at a predetermined gap in the traveling direction of the delivery chain 105. Note that one of the pair of delivery frames 102, one of the pair of sprockets 103, one of the pair of sprockets 104, and one of the pair of delivery chains 105 are shown in FIG. 8, and the other of each member is not illustrated.

A second pile 108 is arranged downstream of a first pile 107 positioned upstream in the sheet convey direction. A movable sheet release cam 110 is arranged above the first pile 107. When the sheet release cam electromagnetic valve (not shown) is turned on, the rod (not shown) of an air cylinder moves forward to position the movable sheet release cam 110 at an operation position. That is, the movable sheet release cam 110 enters the traveling route of the delivery gripper 106 such that the cam surface of the movable sheet release cam 110 is set as indicated by an alternate long and two short dashed line in FIG. 8. When the cam follower of a gripper shaft which supports the delivery gripper 106 is kept in contact with the cam surface of the entered movable sheet release cam 110, the sheet 112 gripped by the delivery gripper 106 is released and dropped onto the first pile 107.

The first state means a state wherein the movable sheet release cam 110 positions at the operation position, i.e., a state wherein the sheet 112 released from the delivery gripper 106 is dropped onto the first pile 107. On the other hand, when the sheet release cam electromagnetic valve is turned off, the rod (not shown) of the air cylinder moves backward to position the movable sheet release cam 110 at a retreat position. That is, the movable sheet release cam 110 is retreated from the traveling route of the delivery gripper 106 such that the movable sheet release cam 110 is set as indicated by a solid line in FIG. 8. When the movable sheet release cam 110 positions at the retreat position, the sheet 112 gripped by the delivery gripper 106 is not delivered to the first pile 107. The sheet 112 which passes above the first pile 107 is conveyed downstream in the sheet convey direction (the direction of an arrow A), and released above the second pile 108. This state is called the second state. A switching device including the sheet release cam electromagnetic valve and air cylinder switches between the first and second states by moving the movable sheet release cam 110 to the operation/retreat positions.

A stationary sheet release cam 114 is arranged above the second pile 108. The cam surface of the stationary sheet release cam 114 always enters the traveling route of the delivery gripper 106 as shown in FIG. 8. Therefore, in the second state, the cam follower of the gripper shaft which supports the delivery gripper 106 is kept in contact with the cam surface of the stationary sheet release cam 114, and the sheet 112 gripped by the delivery gripper 106 is released and dropped onto the second pile 108.

Suction wheels 116 and 117 are arranged upstream in the sheet convey direction above the first and second piles 107 and 108, respectively. The suction wheels 116 and 117 suck, using air, the trailing edge of the sheet 112 released from the delivery gripper 106 to decrease the convey speed of the sheet 112. Lays 118 and 119 are arranged downstream in the sheet convey direction above the first and second piles 107 and 108, respectively. When the leading edge of the sheet 112 which is released from the delivery gripper 106 and whose convey speed is decreased by the suction wheels 116 and 117 abuts against the lays 118 and 119, the circumferential positions of the sheets 112 which are dropped and piled on the first and second piles 107 and 108 are aligned.

Many fans 120 directed to the first pile 107 are arranged above the first pile 107, and many fans 121 directed to the second pile 108 are arranged above the second pile 108. Since the first and second fans 120 and 121 blow air to the sheet 112 released from the delivery gripper 106, the sheet 112 is dropped and piled on the first pile 107 or second pile 108.

A fan shield 122 can be in contact with or separate from the air intake ports of the fans, of the first fans 120, which blow air to the sheet 112 to be dropped onto the first pile 107, i.e., the fans arranged above the first pile 107 on which the sheet 112 is piled between the suction wheel 116 and the lay 118. When the rod (not shown) of the air cylinder moves forward by turning on the fan shield electromagnetic valve, the fan shield 122 is in contact with the air intake ports of the fans 120 to close them. With this operation, the first fans 120 stop blowing air to the sheet 112 which is gripped by the delivery gripper 106 and passing above the first pile 107. On the other hand, when the rod (not shown) of the air cylinder moves backward by turning off the fan shield electromagnetic valve, the fan shield 122 separates from the air intake ports of the first fans 120 to open them.

The upper end of a detection switch 150 is swingably supported by a bracket (not shown) to which the first fans 120 are attached. The detection switch 150 is arranged downstream of the lay 118 in the sheet convey direction to detect the presence/absence of the sheet 112. The lower end of the detection switch 150 is arranged at a position not to interfere with the gripper bar of the delivery gripper 106.

In this arrangement, the first state is set when the movable sheet release cam 110 enters the traveling route of the delivery gripper 106. Next, the air intake ports of the first fans 120, which have been closed by the fan shield 122, are opened so that the first fans 120 blow air to the sheet 112 above the first pile 107. In this state, as shown in FIG. 8, since the cam follower of the delivery gripper 106 which grips and conveys the sheet 112 is kept in contact with the cam surface of the movable sheet release cam 110, and the sheet 112 is released from the delivery gripper 106. As a result, the released sheet 112 is dropped onto the first pile 107 by air from the first fans 120. In this case, the sheet 112 which has failed to be dropped on the first pile 107, overrides the lay 118, and stays between the first and second piles 107 and 108 is detected by the detection switch 150, thus stopping the operation of the machine.

On the other hand, the second state is set when the movable sheet release cam 110 is retreated from the traveling route of the delivery gripper 106. Next, the air intake ports of the first fans 120 are closed by the fan shield 122 so that the first fans 120 do not blow air to the sheet 112 which is passing above the first pile 107. In this state, since the cam follower of the delivery gripper 106 which grips and conveys the sheet 112 is not kept in contact with the cam surface of the movable sheet release cam 110, the sheet 112 gripped by the delivery gripper 106 passes above the first pile 107 and is conveyed to the second pile 108. Since the lower end of the detection switch 150 is arranged at a position not to interfere with the gripper bar of the delivery gripper 106, the delivery gripper 106 passes below the detection switch 150 without contact with the detection switch 150. When the delivery gripper 106 is kept in contact with the cam surface of the stationary sheet release cam, the sheet 112 conveyed above the second pile 108 is released from the delivery gripper 106, dropped onto the second pile 108, and piled there.

However, in the conventional abnormal sheet delivery detection device, the detection switch 150 is arranged at a high position not to interfere with the gripper bar of the delivery gripper 106. Accordingly, the detection switch 150 is spaced apart above the delivery chain 105. In this arrangement, the sheet which has overridden the lay 118 is not detected by the detection switch 150 until the sheet overrides the gripper bar and jammed. Hence, the detection switch 150 delays detecting the sheet which has overridden the lay 118 or suction wheel, and cannot always detect abnormal sheet delivery reliably and instantaneously, thus posing a problem.

SUMMARY OF THE INVENTION

It is an object of the present invention to provide an abnormal sheet delivery detection device which can reliably and instantaneously detect abnormal sheet delivery.

In order to achieve the above object of the present invention, there is provided an abnormal sheet delivery detection device comprising a convey device which includes sheet holding means for holding a sheet, and conveys the sheet held by the sheet holding means, a first pile device on which the sheet released from the sheet holding means is piled at a predetermined sheet release position, noncontact-type detection means arranged downstream of the sheet release position in a sheet convey direction for detecting a presence/absence of the sheet, and first releasing means for selectively switching between a first state in which the sheet held by the sheet holding means is released and piled on the first pile device, and a second state in which the sheet held by the sheet holding means is conveyed downstream in the sheet convey direction by the first convey device without releasing the sheet.

DESCRIPTION OF THE PREFERRED EMBODIMENTS

Figure 1:
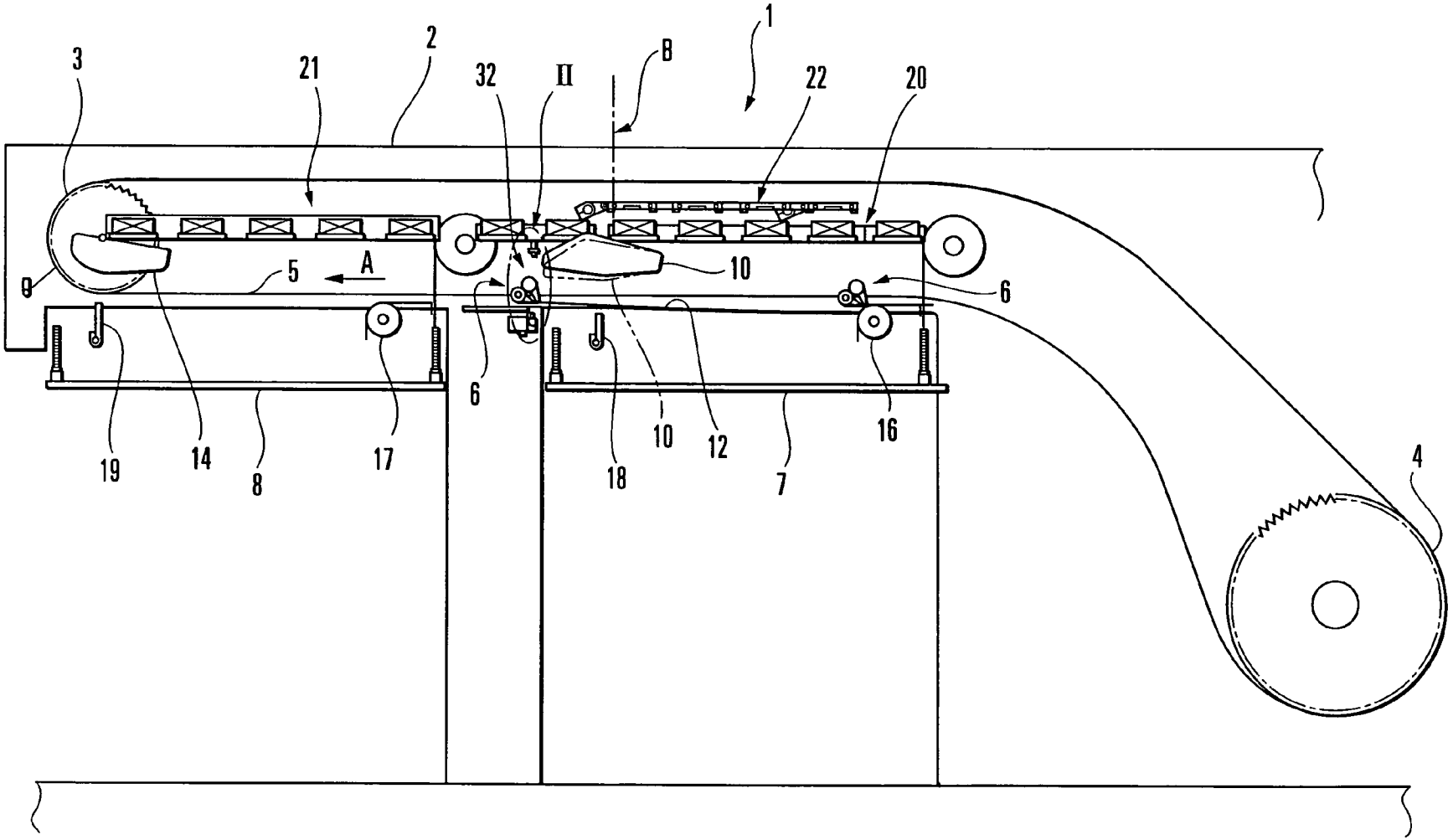
FIG. 1 is a schematic side view of a delivery apparatus of a sheet-fed offset rotary printing press including an abnormal sheet delivery detection device shown in FIG. 3.

The first embodiment of the present invention will be described below with reference to FIGS. 1 to 5. Referring to FIG. 1, a pair of sprockets 3 are rotatably supported at the upper rear ends of a pair of delivery frames 2 arranged to oppose each other at a predetermined gap. A pair of delivery chains 5 which travel in the direction of an arrow A are looped between the pair of sprockets 3 and a pair of sprockets 4 arranged to be coaxial with a delivery cylinder which is in contact with the last printing cylinder. A convey device includes the pairs of sprockets 3 and 4, the pair of delivery chains 5, and a plurality of delivery grippers 6. Note that one of the pair of delivery frames 2, one of the pair sprockets 3, one of the pair sprockets 4, and one of the pair delivery chains 5 are shown in FIG. 1, and the other of each member is not illustrated.

A gripper bar having the plurality of delivery grippers 6 (sheet holding means) which grip and convey a sheet 12 is supported between the pair of delivery chains 5 at a predetermined gap in the traveling direction of the delivery chain 5. A gripper device includes a plurality of pairs of the delivery grippers 6 and gripper pads, and a cam follower.

A second pile 8 (second pile device) is arranged downstream of a first pile 7 (first pile device) positioned upstream in the sheet convey direction. A movable sheet release cam 10 (first releasing means) is arranged above the first pile 7. When the sheet release cam electromagnetic valve (not shown) is turned on, the rod (not shown) of an air cylinder moves forward to position the movable sheet release cam 10 at an operation position. That is, the movable sheet release cam 10 enters the traveling route of the delivery gripper 6 such that the cam surface of the movable sheet release cam 10 is set as indicated by an alternate long and two short dashed line in FIG. 1. When the cam follower of the delivery gripper 6 is kept in contact with the cam surface of the entered movable sheet release cam 10, the sheet 12 gripped by the delivery gripper 6 is released and dropped onto the first pile 7.

The first state means a state wherein the movable sheet release cam 10 positions at the operation position, i.e., a state wherein the sheet 12 released from the delivery gripper 6 is dropped onto the first pile 7. On the other hand, when the sheet release cam electromagnetic valve is turned off, the rod (not shown) of the air cylinder moves backward to position the movable sheet release cam 10 at a retreat position. That is, the movable sheet release cam 10 is retreated from the traveling route of the delivery gripper 6 such that the movable sheet release cam 10 is set as indicated by a solid line in FIG. 1. When the movable sheet release cam 10 positions at the retreat position, the sheet 12 gripped by the delivery gripper 6 is not delivered to the first pile 7. The sheet 12 which passes above the first pile 7 is conveyed downstream in the sheet convey direction (the direction of an arrow A), and released above the second pile 8. This state is called the second state. A switching device including the sheet release cam electromagnetic valve and air cylinder switches between the first and second states by moving the movable sheet release cam 10 to the operation/retreat positions.

A stationary sheet release cam 14 (second releasing means) is arranged above the second pile 8. The cam surface of the stationary sheet release cam 14 always enters the traveling route of the delivery gripper 6 as shown in FIG. 1. Therefore, in the second state, the cam follower of the delivery gripper 6 is kept in contact with the cam surface of the stationary sheet release cam 14, and the sheet 12 gripped by the delivery gripper 6 is released and dropped onto the second pile 8.

Suction wheels 16 and 17 (decelerating means) are arranged upstream in the sheet convey direction above the first and second piles 7 and 8, respectively. The suction wheels 16 and 17 suck, using air, the trailing edge of the sheet 12 released from the delivery gripper 6 to decrease the convey speed of the sheet 12. Lays 18 and 19 are arranged downstream in the sheet convey direction above the first and second piles 7 and 8, respectively. When the leading edge of the sheet 12 which is released from the delivery gripper 6 and whose convey speed is decreased by the suction wheels 16 and 17 abuts against the lays 18 and 19, the circumferential positions of the sheets 12 which are dropped and piled on the first and second piles 7 and 8 are aligned.

Many first fans 20 (upstream air blowing means) directed to the first pile 7 are arranged above the first pile 7, and many second fans 21 (downstream air blowing means) directed to the second pile 8 are arranged above the second pile 8. Since the first and second fans 20 and 21 blow air to the sheet 12 released from the delivery gripper 6, the sheet 12 is dropped and piled on the first pile 7 or second pile 8.

A fan shield 22 (blowing air shut-down means) can be in contact with or separate from the air intake ports of the fans, of the first fans 20, which blow air to the sheet 12 to be dropped onto the first pile 7, i.e., the fans arranged above the first pile 7 on which the sheet 12 is piled between the suction wheel 16 and the lay 18. When the rod (not shown) of the air cylinder moves forward by turning on the fan shield electromagnetic valve, the fan shield 22 is in contact with the air intake ports of the fans 20 to close them. With this operation, the first fans 20 stop blowing air to the sheet 12 which is gripped by the delivery gripper 6 and passing above the first pile 7. On the other hand, when the rod (not shown) of the air cylinder moves backward by turning off the fan shield electromagnetic valve, the fan shield 22 separates from the air intake ports of the first fans 20 to open them.

A noncontact sensor 32 (detection means) which detects abnormal delivery of the sheet 12 is arranged downstream of the lay 18 in the convey direction of the sheet 12 (the direction of an arrow A) and upstream of the second pile 8 in the convey direction of the sheet 12. When the cam follower of the gripper shaft which supports the delivery gripper 6 is kept in contact with the movable sheet release cam 10, the sensor 32 is arranged downstream of a release position B at which the sheet 12 is released from the delivery gripper 6, in the convey direction of the sheet 12.

Figure 2:
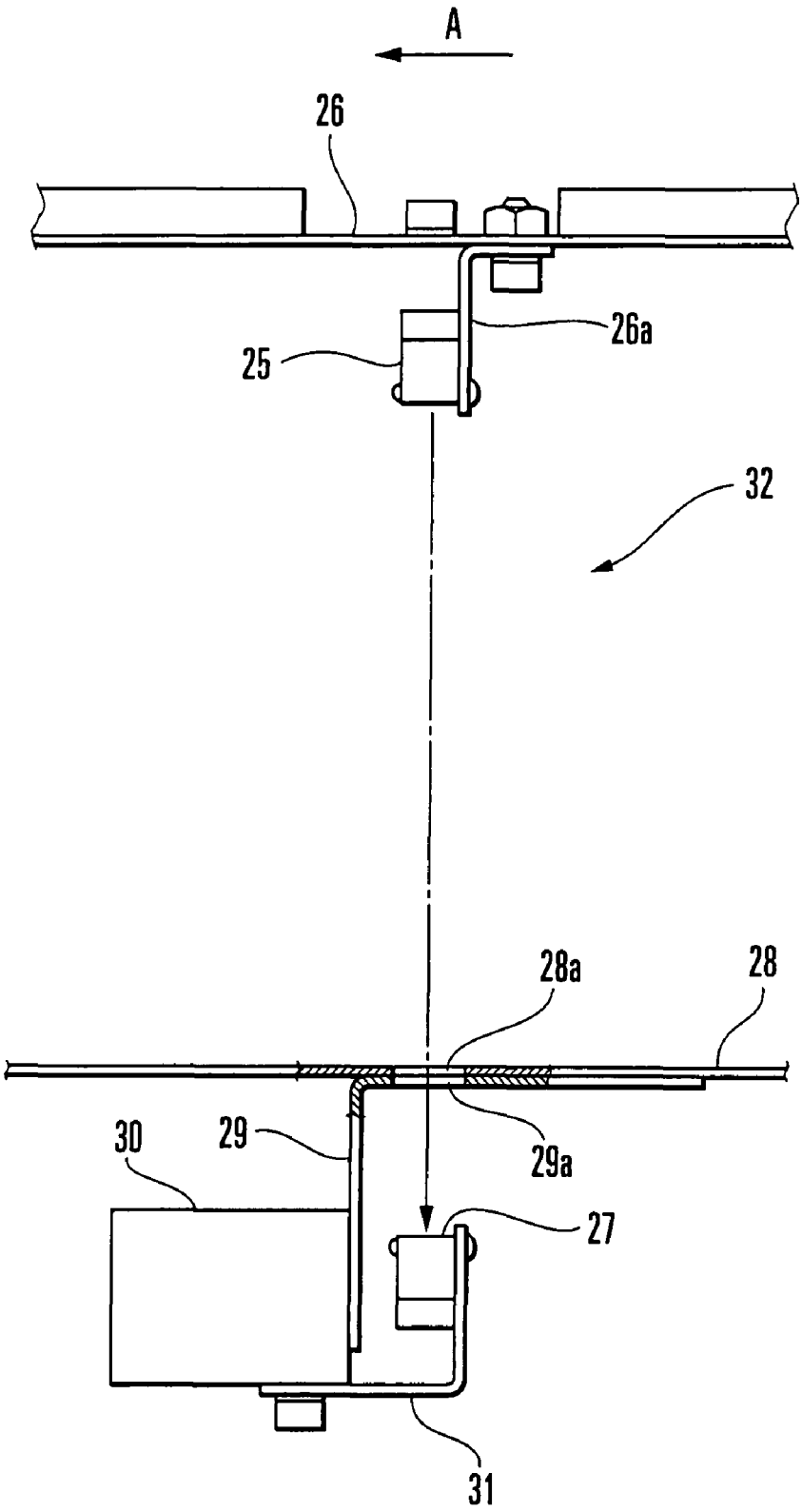
FIG. 2 is an enlarged view of a portion II in FIG. 1.

Referring to FIG. 2, the sensor 32 includes a light-emitting device 25 and a photosensor 27 which is arranged to oppose the light-emitting device 25 across the delivery chain 5 and receives light from the light-emitting device 25. The light-emitting device 25 is attached, via a bracket 26*a*, to a support plate 26 to which the first fans 20 are fixed. The photosensor 27 is attached, via a bracket 29, tie-bar 30, and bracket 31, to a guide plate 28 which is attached to the delivery frame 2 to guide the sheet set between the first and second piles 7 and 8. The guide plate 28 and bracket 29 have windows 28*a* and 29*a*, respectively. Light emitted from the light-emitting device 25 passes through the windows 28*a* and 29*a*, and is received by the photosensor 27.

Figure 3:
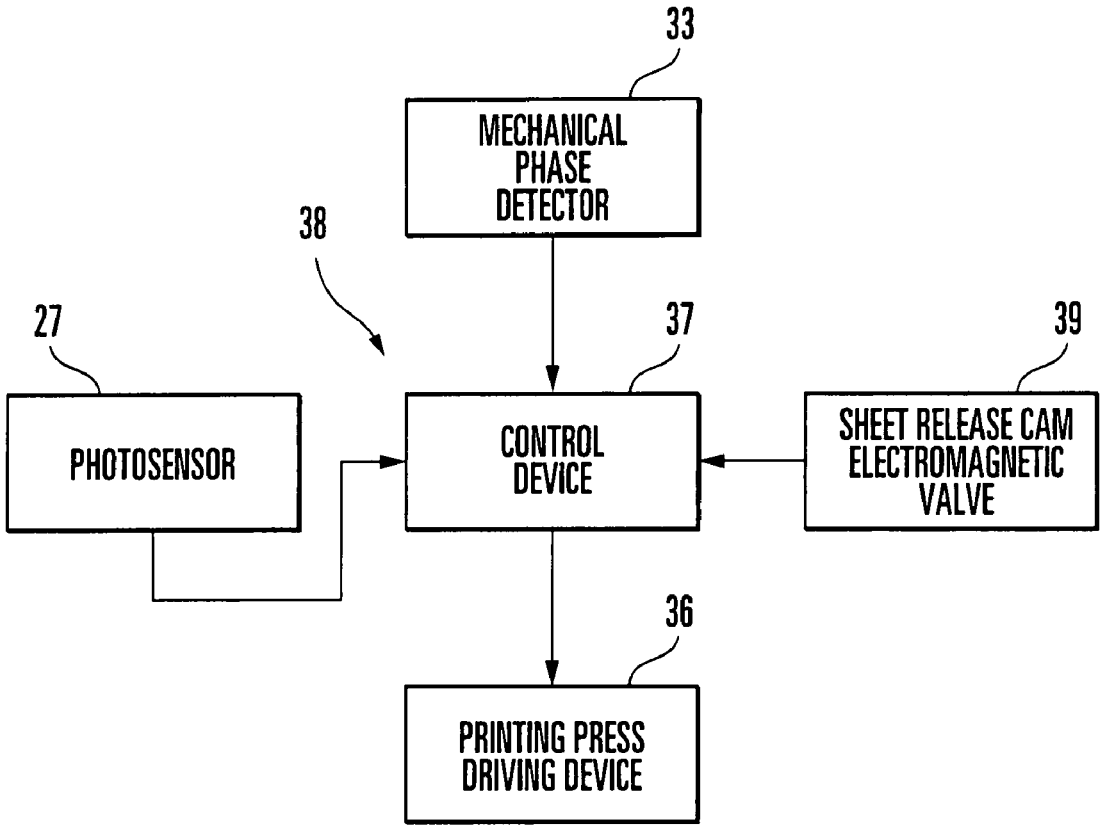
FIG. 3 is a block diagram showing the arrangement of the abnormal sheet delivery detection device according to the first embodiment of the present invention.

Referring to FIG. 3, an abnormal sheet delivery detection device 38 includes the photosensor 27 of the sensor 32, a mechanical phase detector 33 comprising a rotary encoder which generates a rotation pulse indicating the phase of the printing press along with driving of the printing press, a printing press driving device 36 which drives the printing press, and a control device 37 (control means). The control device 37 detects abnormal sheet delivery based on the outputs from the photosensor 27 and mechanical phase detector 33. Upon detection of abnormal sheet delivery, the control device 37 outputs a stop signal to the printing press driving device 36 to stop driving the printing press.

A sheet release cam electromagnetic valve 39 is connected to the control device 37. When the sheet release cam electromagnetic valve 39 is turned on, the rod (not shown) of an air cylinder moves forward to position the movable sheet release cam 10 at an operation position. That is, the movable sheet release cam 10 enters the traveling route of the delivery gripper 6 so that the cam surface of the, movable sheet release cam 10 is set as indicated by an alternate long and two short dashed line in FIG. 1. When the cam follower of the delivery gripper 6 is kept in contact with the cam surface of the entered movable sheet release cam 10, the sheet 12 gripped by the delivery gripper 106 is released and dropped onto the first pile 107.

An operation of the control device 37 to judge abnormal sheet delivery based on a detection signal from the sensor 32 which detects the presence/absence of the sheet will be described below using FIGS. 4A to 4C. According to this embodiment, note that a timing (mechanical phase) at which the sheet does not generally exist is set between when the trailing edge of a preceding sheet conveyed by the delivery gripper passes through the sensor and when the leading edge of a succeeding sheet (to be conveyed by the next delivery gripper) reaches the sensor. Upon detection of the presence/absence of the sheet at this timing, the control device 37 judges abnormal delivery.

Figure 4A:
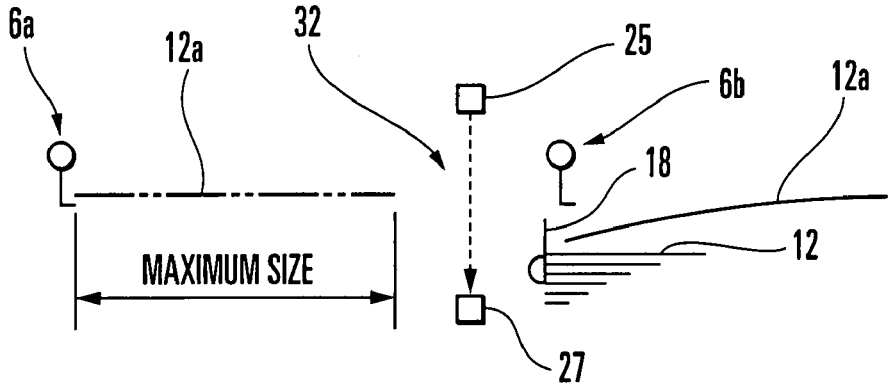
FIG. 4A is a view for explaining the principle of an abnormal sheet delivery detection process according to the first embodiment.
Figure 4B:
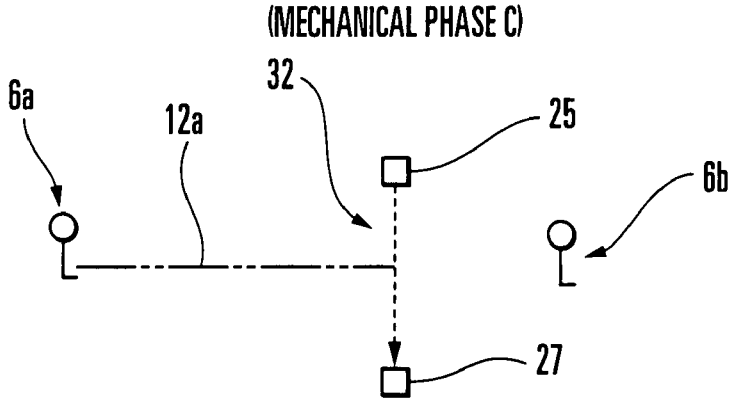
FIG. 4B is a view showing a mechanical phase C.
Figure 4C:
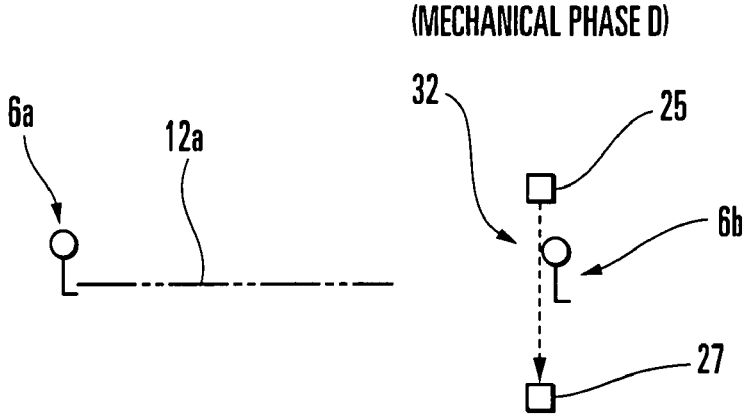
FIG. 4C is a view showing a mechanical phase D.

FIG. 4A shows the first state wherein a maximum-size sheet 12*a* is dropped and piled on the first pile 7. Assume that a delivery gripper 6*a* grips the maximum-size sheet 12*a*. The control device 37 calculates the mechanical phase of the printing press based on the output from the mechanical phase detector 33. When the mechanical phase of the printing press is set between a mechanical phase C (FIG. 4B) that the trailing edge of the sheet 12*a* gripped by the delivery gripper 6*a* passes through the sensor 32, and a mechanical phase D (FIG. 4C) that the succeeding delivery gripper 6*b* reaches the sensor 32, the control device 37 monitors abnormal sheet delivery. More specifically, the control device 37 checks the signal from the sensor 32 at a predetermined timing when the mechanical phase is set between the mechanical phases C and D. When the signal from the sensor 32 indicates that the sensor detects the sheet, i.e., when the sheet shields light from the light-emitting device 25 to the photosensor 27, the control device 37 judges abnormal sheet delivery.

That is, when the photosensor 27 of the sensor 32 is ON between the mechanical phases C and D, the control device 37 judges sheet normal delivery. On the other hand, when the photosensor 27 of the sensor 32 is OFF (when the sheet shields light from the light-emitting device 25 to the photosensor 27) between the mechanical phases C and D, the control device 37 judges abnormal sheet delivery.

Figure 5:
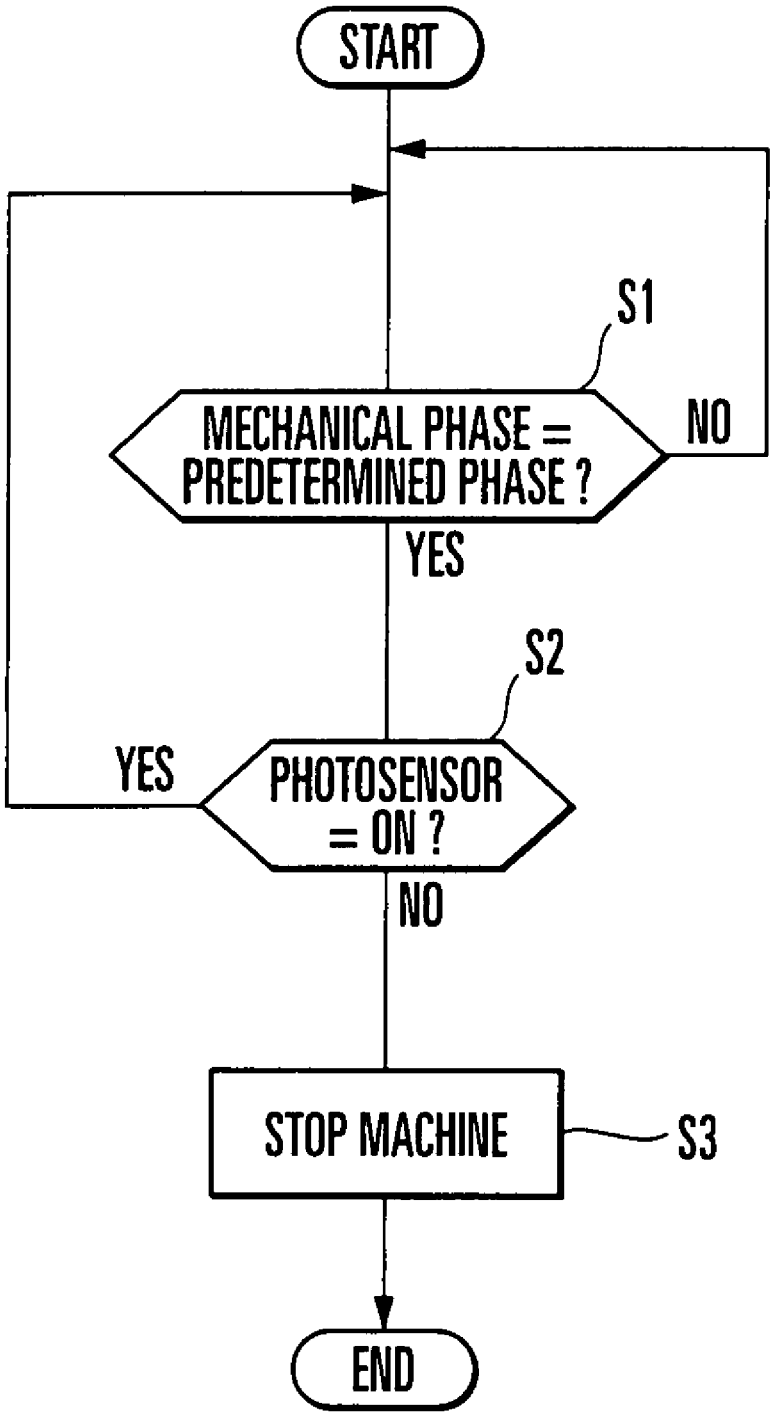
FIG. 5 is a flowchart for explaining the abnormal sheet delivery detection process performed by a control device shown in FIG. 3.

An abnormal sheet delivery detection process (determination process) of the control device 37 will be described in detail below with reference to FIG. 5. In the first state wherein the movable sheet release cam 10 enters the traveling route of the delivery gripper 6, the sheet 12 which is conveyed by traveling of the delivery chain 5 while being gripped by the delivery gripper 6 of the gripper device is released from the delivery gripper 6 at a release position B. The released sheet 12 is dropped onto the first pile 7, and their leading edges abut against the lay 18. Accordingly, the sheets 12 are piled-on the first pile 7 while their circumferential positions are aligned. On the other hand, in the second state wherein the movable sheet release cam 10 is retreated from the traveling route of the delivery gripper 6, the sheet 12 which is conveyed by the delivery chain 5 while being griped by the delivery gripper 6 passes through the first pile 7 without being dropped there. When the cam follower of the gripper shaft which supports the delivery gripper 6 is kept in contact with the cam surface of the stationary sheet release cam 14, the sheet 12 which has passed through the first pile 7 is released from the delivery gripper 6. The released sheet 12 is dropped onto the second pile 8, and its leading edge abuts against the lay 18. Accordingly, the sheet 12 is piled on the second pile 8 while its circumferential position is aligned.

In the above operations, the control device 37 calculates the mechanical phase of the printing press based on the output from the mechanical phase detector 33 to repeat a process in step S1 until the mechanical phase of the printing press is set to a predetermined position between the mechanical phases C and D. When the mechanical phase is set to a predetermined phase in step Si, the process advances to step S2. In step S2, when the signal from the sensor 32 indicates that the photosensor 27 is ON upon reception of light from the light-emitting device 25, the control device 37 judges that no sheet 12 overrides the lay 18, and the process returns to step S1.

On the other hand, in step S2, when the signal from the sensor 32 indicates that the photosensor 27 is OFF upon reception of no light from the light-emitting device 25, the control device 37 judges that the sheet 12 overrides the lay 18. In this case, the process shifts to step S3, and the control device 37 controls the printing press driving device 36 to stop the printing press. As described above, when only one sheet 12 overrides the lay 18, the sensor 32 detects the abnormally delivered sheet 12, and stops the printing press. This can prevent wasted paper and the trouble of a machine.

According to the above-described first embodiment, upon detection of delivery abnormality at a timing between when the trailing edge of the maximum-size sheet 12*a* passes and when the succeeding delivery gripper 6*b* reaches, delivery abnormality of the sheet 12 of any size can be detected without changing the timing. Even if the sheet 12 is delivered to either the first pile 7 or the second pile 8, the control operation need not be switched.

With reference to FIGS. 6A to 6C and FIG. 7, the second embodiment of the present invention will be described below. According to this embodiment, since the electrical arrangement of an abnormal sheet delivery detection device is the same as that in the first embodiment, FIG. 3 is used. In the second embodiment, in addition to abnormal delivery that a sheet overrides a lay 18, the abnormal sheet delivery detection device detects abnormal delivery other than this. That is, the abnormal sheet delivery detection device can detect abnormal delivery so-called "regripping" that a sheet 12 which has released by a delivery gripper 6 is gripped by the delivery gripper 6 again.

Figure 6A:
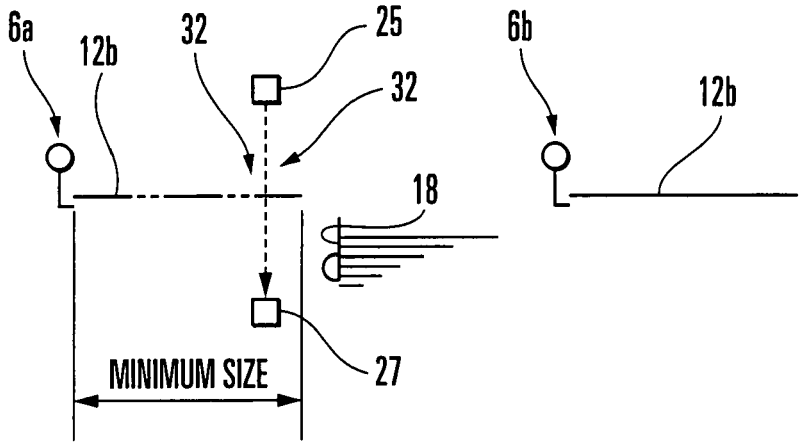
FIG. 6A is a view for explaining the principle of an abnormal sheet delivery detection process according to the second embodiment.
Figure 6B:
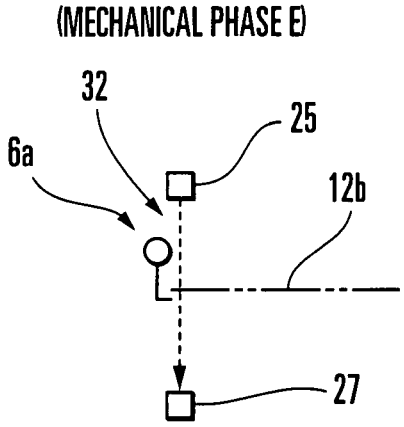
FIG. 6B is a view showing a mechanical phase E.
Figure 6C:
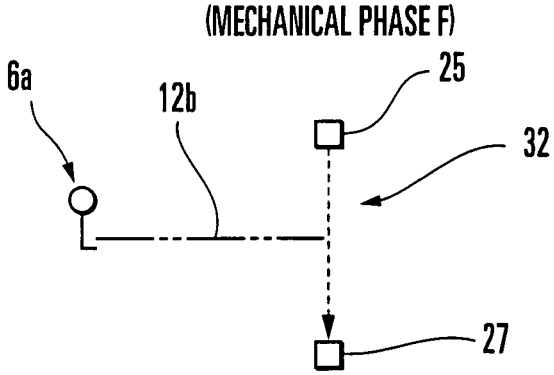
FIG. 6C is a view showing a mechanical phase F.

FIG. 6A shows the first state wherein a minimum-size sheet 12*b* is dropped and piled on a first pile 7. Assume that a delivery gripper 6*a* grips the minimum-size sheet 12*b*. In this case, a control device 37 monitors abnormal sheet delivery between a mechanical phase E (FIG. 7B) that the delivery gripper 6*a* which has passed above the first pile 7 passes through a sensor 32, and a mechanical phase F (FIG. 7C) that the trailing edge of the minimum-size sheet 12*b* gripped by the delivery gripper 6*a* reaches the sensor 32.

That is, when the sheet 12*b* is dropped onto the first pile 7, the control device 37 monitors abnormal sheet delivery between the mechanical phases E and F. The control device 37 checks a signal from the sensor 32 at a predetermined timing between the mechanical phases E and F. When the signal from the sensor 32 indicates that a photosensor 27 is ON, the control device 37 judges normal delivery. On the other hand, when the signal from the sensor 32 indicates that the photosensor 27 is OFF, the control device 37 judges abnormal delivery.

Figure 7:
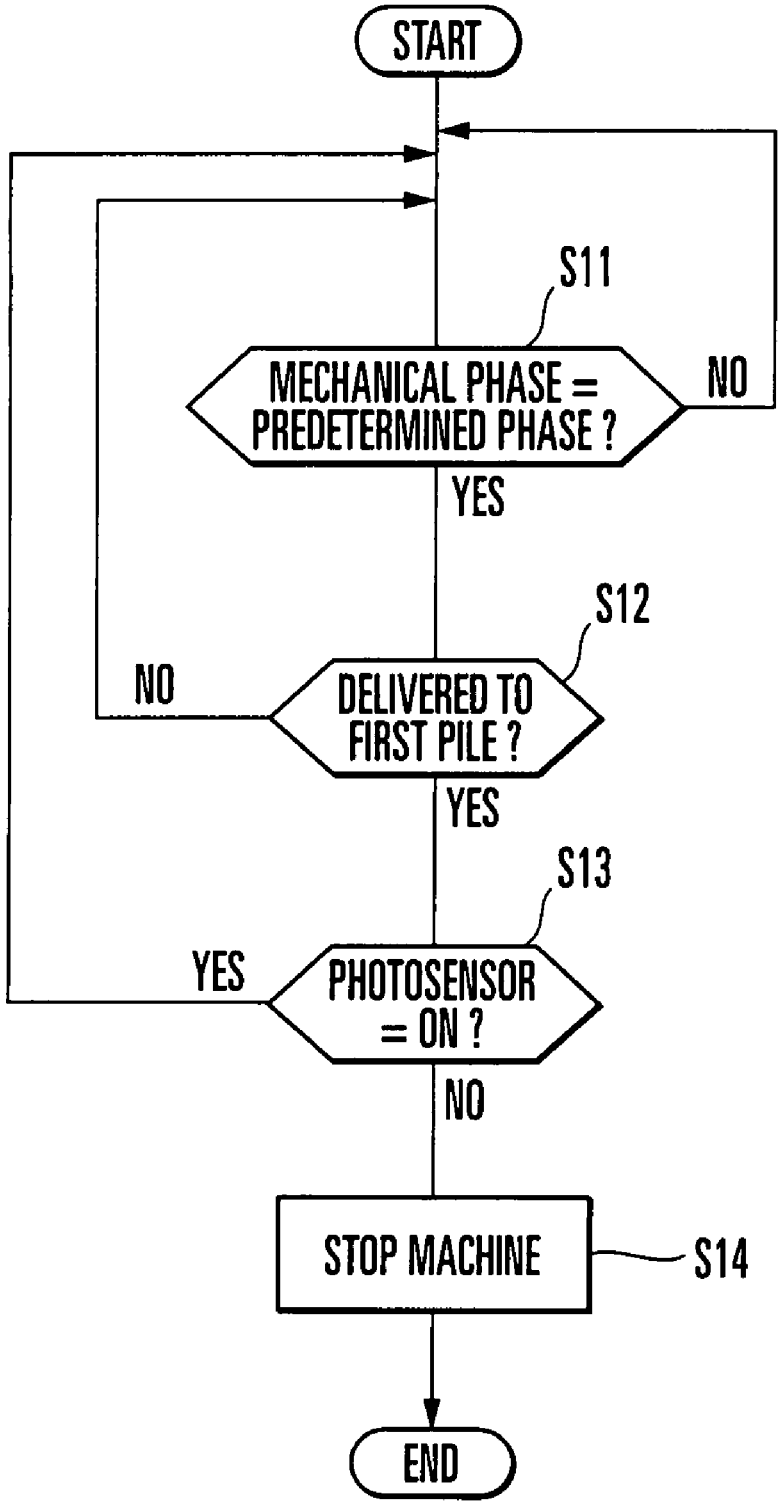
FIG. 7 is a flowchart for explaining an abnormal sheet delivery detection process according to the second embodiment.
Figure 8:
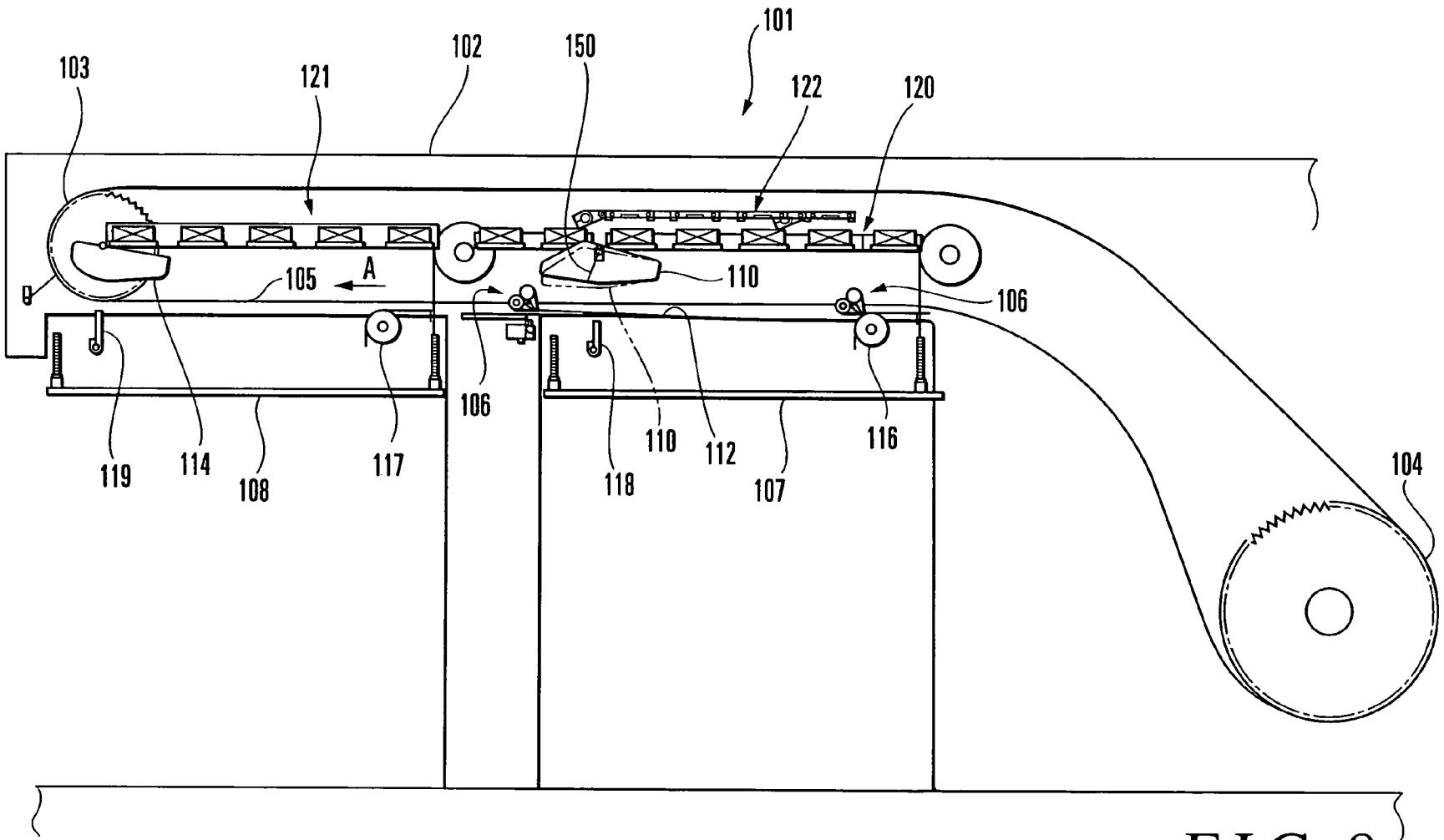
FIG. 8 PRIOR ART
FIG. 8 is a schematic side view of a delivery apparatus of a sheet-fed offset rotary printing press including a conventional abnormal sheet delivery detection device.

Referring to FIG. 7, an abnormal sheet delivery detection process (determination process) of the control device 37 will be described next. In the first state wherein a movable sheet release cam 10 enters the traveling route of the delivery gripper 6, the sheet 12 which is conveyed by traveling of a delivery chain 5 while being gripped by the delivery gripper 6 is released from the delivery gripper 6 at a release position B. Upon dropping onto the first pile 7 and abutting their leading edges against the lay 18, the released sheet 12 is piled on the first pile 7 while its circumferential position is aligned. On the other hand, in the second state wherein the movable sheet release cam 10 is retreated from the traveling route of the delivery gripper 6, the sheet 12 which is conveyed by the delivery chain 5 while being gripped by the delivery gripper 6 passes above the first pile 7 without being dropped there. When the cam follower of the gripper shaft which supports the delivery gripper 6 is kept in contact with the cam surface of a stationary sheet release cam 14, the sheet 12 which has passed above the first pile 7 is released from the delivery gripper 6. Upon dropping onto a second pile 8 and abutting its leading edge against a lay 19, the released sheet 12 is piled on the second pile 8 while its circumferential position is aligned.

In the above operations, a process in step S11 is repeated until the mechanical phase is set to a predetermined phase (e.g., a mechanical phase shown in FIG. 6A) between the mechanical phases E and F. On the other hand, when the mechanical phase is set to the predetermined phase in step S11, the process advances to step S12. In the second state wherein the movable sheet release cam 10 positions at the retreat position and the sheet 12 passes above the first pile 7 in step S12, the process returns to step S11 without judging abnormal sheet delivery. In the first state wherein the movable sheet release cam 10 positions at the operation position and the sheet 12 is piled on the first pile 7 in step S12, the process advances to step S13. When the signal from the sensor 32 indicates that the photosensor 27 is ON upon reception of light from a light-emitting device 25, the control device 37 judges that no sheet 12 overrides the lay 18, and the process returns to step S11.

When the signal from the sensor 32 indicates that the photosensor 27 is OFF upon reception of no light from the light-emitting device 25, the control device 37 judges that the sheet 12 passes above the first pile 7 by overriding the lay 18 or being regripped. The process then advances to step S14. In step S14, the control device 37 controls a printing press driving device 36 to stop the printing press. As described above, the abnormal sheet delivery detection device can detect not only the sheet 12 overriding the lay 18 but also the sheet 12 which passes above the first pile 7 by being regripped. This can prevent wasted paper and the trouble of a machine.

According to the second embodiment, since the abnormal sheet delivery detection device detects abnormal sheet delivery at a timing between when the leading edge of the minimum-size sheet 12*b* passes through the sensor 32 and when the trailing edge of the sheet 12*b* reaches the sensor 32, delivery abnormality of the sheet 12 of any size can be detected without changing the timing.

According to the first and second embodiments, the sheet 12 which has passed above the first pile 7 is piled on the second pile 8. However, the second pile 8 is not always required. That is, the sheet 12 which has passed above the first pile 7 may be conveyed by a conveyor belt or the like without being piled, or may be extracted as a sample sheet or the like. In this case, the second pile 8 is not required. In these embodiments, the abnormal sheet delivery detection device is applied to the delivery apparatus of the sheet-fed offset rotary printing press. However, the present invention is not limited to this. The abnormal sheet delivery detection device can also be applied to a coating apparatus or a checking apparatus which checks the printing quality of a sheet.

In these embodiments, the sheet 12 is used as a paper sheet. However, the sheet 12 may be replaced with a film-like sheet or aluminum plate. In the above description, the sensor 32 serves as a photoelectric sensor including the light-emitting device 25 and the photosensor 27. However, the sensor 32 may serve as an ultrasonic sensor. In this case, the sensor can detect the presence/absence of the sheet even if the sheet is a light transmission film.

As has been described above, according to the present invention, the sheet which has overridden the lay can be reliably and instantaneously detected by a noncontact detection means arranged downstream of the lay in the sheet convey direction. This can prevent wasted paper and the trouble of a machine.

What is claimed is:

1. An abnormal sheet delivery detection device comprising:

a convey device which includes sheet holding means for holding a sheet, and conveys the sheet held by said sheet holding means;

a first pile device on which the sheet released from said sheet holding means at a predetermined sheet release position is piled;

noncontact-type detection means arranged downstream of the sheet release position in a sheet convey direction for detecting one of a presence and an absence of the sheet;

first releasing means for selectively switching between a first state in which the sheet held by said sheet holding means is released and piled on said first pile device, and a second state in which the sheet held by said sheet holding means is conveyed downstream in the sheet convey direction by said first convey device without releasing the sheet at the release position; and a control means for detecting abnormal sheet delivery based on an output from said detection means in a period elapsing from a time a trailing edge of a sheet held by said sheet holding means passes a detection position of said detection means until a next succeeding sheet holding means reaches the detection position of said detection means.

2. A device according to claim 1, further comprising a first lay which is arranged downstream of said first pile device in the sheet convey direction, and against which a leading edge of the sheet piled on said first pile device abuts, wherein said detection means is arranged downstream of said first lay in the sheet convey direction.

3. A device according to claim 2, further comprising a second pile device which is arranged downstream of said first pile device in the sheet convey direction, and on which the sheet released from said sheet holding means is piled, wherein said detection means is arranged between said first pile device and said second pile device.

4. A device according to claim 3, further comprising a second lay which is arranged downstream of said second pile device in the sheet convey direction, and against which the leading edge of the sheet piled on said second pile device abuts, and second releasing means for releasing the sheet held by said sheet holding means, where the sheet released from said second releasing means is piled on said second pile device.

5. An abnormal sheet delivery detection device comprising:

a convey device which includes sheet holding means for holding a sheet, and conveys the sheet held by said sheet holding means;

a first pile device on which the sheet released from said sheet holding means at a predetermined sheet release position is piled;

noncontact-type detection means arranged downstream of the sheet release position in a sheet convey direction for detecting one of a presence and an absence of the sheet;

first releasing means for selectively switching between a first state in which the sheet held by said sheet holding means is released and piled on said first pile device, and a second state in which the sheet held by said sheet holding means is conveyed downstream in the sheet convey direction by said first convey device without releasing the sheet at the release position; and control means for judging abnormal sheet delivery based on an output from said detection means from when a trailing edge of a maximum-size sheet held by said sheet holding means passes through a detection position of said detection means to when a succeeding sheet holding means reaches the detection position of said detection means.

6. A device according to claim 5, wherein said control means checks an output from said detection means at a predetermined timing between when the trailing edge of the maximum-size sheet held by said sheet holding means passes through the detection position of said detection means and when the succeeding sheet holding means reaches the detection position of said detection means.

7. A device according to claim 1, wherein said detection means is a photoelectric sensor.

8. A device according to claim 1, wherein said detection means is an ultrasonic sensor.

9. A device according to claim 1, further comprising control means for, when said first releasing means is in the first state, judging abnormal sheet delivery based on an output from said detection means from when said sheet holding means passes through a detection position of said detection means to when a trailing edge of a minimum-size sheet held by said sheet holding means passes through the detection position of said detection means.

10. A device according to claim 9, wherein said control means checks the output from said detection means at a predetermined timing between when said sheet holding means passes through the detection position of said detection means and when the trailing edge of the minimum-size sheet held by said sheet holding means passes through the detection position of said detection means.

11. A device according to claim 1, wherein said sheet holding means includes a gripper device which grips the sheet and travels, said first releasing means includes a cam member which abuts against said gripper device to release the sheet gripped by said gripper device, and said cam member enters a traveling route of said gripper device in the first state, and is retreated from the traveling route of said gripper device in the second state.

12. A device according to claim 1, wherein said control means judges abnormal sheet delivery based on the output from said detection means in a period elapsing from a mechanical phase of an associated printing press corresponding to the time the trailing edge of the sheet held by said sheet holding means passes the detection position of said detection means to another mechanical phase of the associated printing press corresponding to the time said next succeeding sheet holding means reaches the detection position of said detection means.

13. A device according to claim 12, wherein said control means judges abnormal sheet delivery based on an output of said detection means regardless whether said first releasing means is in the first state or in the second state.

14. A device according to claim 1, wherein said control means checks an output from said detection means at a predetermined timing between when the trailing edge of the sheet held by said sheet holding means passes through the detection position of said detection means and when the succeeding sheet holding means reaches the detection position of said detection means.

* * * * *